US009574727B2

(12) United States Patent
Estell

(10) Patent No.: US 9,574,727 B2
(45) Date of Patent: Feb. 21, 2017

(54) CONTAINER CANDLE LID SYSTEM

(71) Applicant: Kent Darrin Estell, Redmond, OR (US)

(72) Inventor: Kent Darrin Estell, Redmond, OR (US)

(73) Assignee: Kent Estell, Redmond, OR (US)

( * ) Notice: Subject to any disclaimer, the term of this patent is extended or adjusted under 35 U.S.C. 154(b) by 215 days.

(21) Appl. No.: 14/099,947

(22) Filed: Dec. 7, 2013

(65) Prior Publication Data

US 2015/0159823 A1 Jun. 11, 2015

(51) Int. Cl.

| | |
|---|---|
| ***F21V 33/00*** | (2006.01) |
| ***F21S 6/00*** | (2006.01) |
| ***F21V 35/00*** | (2006.01) |
| ***F21S 9/02*** | (2006.01) |
| *F21Y 101/02* | (2006.01) |
| *F21Y 101/00* | (2016.01) |

(52) U.S. Cl.

CPC ..... *F21S 6/001* (2013.01); *F21S 9/02* (2013.01); *F21V 35/00* (2013.01); *F21Y 2101/00* (2013.01); *F21Y 2101/02* (2013.01)

(58) Field of Classification Search

CPC ..... F21S 6/001
USPC ..... 431/288, 289; 362/154
See application file for complete search history.

(56) References Cited

U.S. PATENT DOCUMENTS

| | | | | |
|---|---|---|---|---|
| 2,760,052 | A * | 8/1956 | Owen | A01G 5/00 362/123 |
| 2009/0170046 | A1* | 7/2009 | Wooten | 431/289 |
| 2010/0209861 | A1* | 8/2010 | Von Zell | 431/156 |
| 2011/0051421 | A1* | 3/2011 | Chew | 362/249.06 |
| 2012/0044671 | A1* | 2/2012 | Gourdie et al. | 362/161 |

OTHER PUBLICATIONS

Rose, Sephanie. Mason Jar Solar Lights. Aug. 31, 2012. Garden Therapy. http://gardentherapy.ca/mason-jar-solar-lights/.*

Sharon. How to Decorate and Reuse Glass Jars. Aug. 16, 2013. make it or fix it yourself!. http://makeitorfixit.com/how-to-reuse-decorate-glass-jars/.*

* cited by examiner

*Primary Examiner* — Steven B McAllister
*Assistant Examiner* — Rabeeul Zuberi

(57) ABSTRACT

The present invention is an adaptation of the common container candle lid. The lid is transparent or translucent and it is hollow. The lid contains at least one piece of two-dimensional material that is applied to the interior surface of the lid, thereby giving the material a three-dimensional presentation. The material is held in place by foam that also holds, in the mouth of the candle lid, at least one LED and the components necessary to energize the LED when desired.

4 Claims, 3 Drawing Sheets

CONTAINER CANDLE LID SYSTEM

FIELD OF THE INVENTION

The present invention relates to a candle lid system and, more particularly, a method whereby a lid enhances and improves an ordinary container candle.

BACKGROUND OF THE INVENTION

In the lighting arts, no less than three patents—U.S. Pat. No. 20030210555 to Cicero, U.S. Pat. No. 8,496,346 to Zinox, and U.S. Pat. No. 7,938,554 to Franks—incorporate a light emitting diode (LED) into a lid that may or may not have ornamental features. However, each of these three inventions are designed to prevent the fire hazard posed by leaving a candle in a jack-o-lantern; none aim to complement or enhance a candle of any sort.

Alternately, candle toppers are used to increase the decorative appeal of a lit or unlit container candle, while lids for container candles are typically used to keep the wax of a container candle dust-free when unlit and, in some cases, to conceal an unsightly, previously burned wick.

Some candle toppers offer additional utility. For example, U.S. Pat. No. 6,758,666 issued to Strunak, provides a topper with a hidden compartment into which one can place matches, money, or other items that one might prefer to conceal. Strunak's invention also provides a way to display photographs on the outside of the topper. Similar to Strunak's invention, U.S. Pat. No. 20,060,210,940 to Greiner, provides a system for storing small items related to a candle, such as matches and scent oil.

While the aforementioned patents to Strunak and Greiner improve a container candle, both inventions leave other aspects of a typical container candle unaddressed.

For example, the vast majority of container candles come with a transparent or translucent lid that offers very little aesthetically. That is, they usually consist of nothing more than clear glass and, therefore, a way to improve the aesthetics of the lid is needed.

Also, one may wish to experience the ambiance of a container candle without lighting it. To do so, one must acquire a small battery powered light, turn it on, place it inside the container and, when one is finished using the light, fish the light out of the container candle and turn the light off.

Further, if one wishes to continue experiencing the ambiance of a container candle after its original fuel is exhausted, a routine similar to the one described above will likely follow (i.e., acquire light, turn it on, place it inside, enjoy, fish it out, turn it off).

Hence, there is a need for a lid system that, in addition to protecting a container candle from dust when unlit, (1) improves its overall aesthetic by turning at least one piece of two-dimensional material (such as a piece of paper, piece of fabric, photo or illustration) into a three-dimensional embellishment that is applied to the interior surface of the lid and is, therefore, protected when the lid is applied to or removed from the container candle; (2) provides one the ability to experience the ambiance of the container candle without lighting it, and (3) provides one the ability to continue experiencing the ambiance of the container candle after its fuel is exhausted.

SUMMARY OF THE INVENTION

The lid is hollow, consisting of a transparent or translucent outer shell which defines an interior cavity, into which is nested foam, preferably made of polyurethane, and, within the foam, is nested at least one LED with its own housing (which also contains the necessary components to energize and de-energize the LED). Between the interior surface of the lid and the nested foam is at least one sheet of two-dimensional, decorative material, which, because of its application to the interior surface of the lid, has a three-dimensional appearance (when viewed after the lid is coupled with a container candle).

The lid can be removably or hingedly attached to a variety of containers but, in particular, a container candle.

The lid can be decorative as a stand-alone design, or an integral part of the overall design of a container candle.

Preferably, the two-dimensional material within the lid matches the design theme of the container candle to which it is attached.

Alternatively, the two-dimensional material may be fused to the foam.

Alternatively, the lid may use the color and/or texture of the foam to create a design aesthetic.

In some embodiments, a candle system is provided, which includes a container candle and at least one lid as described above.

Alternately, a candle system may comprise everything described in the prior 6 paragraphs, as well as an LED in its own housing that is nested in the foam, or an LED that is nested directly into the foam without housing.

In some embodiments, the LED may have a small fixture attached to it that looks like a flame, star, flower, or some other ornamental shape, and said shape may protrude slightly into the mouth of the container candle to which the lid is attached.

BRIEF DESCRIPTION OF THE DRAWINGS

Four drawings are used to depict the invention.

DETAILED DESCRIPTION OF THE INVENTION

Figure 1:
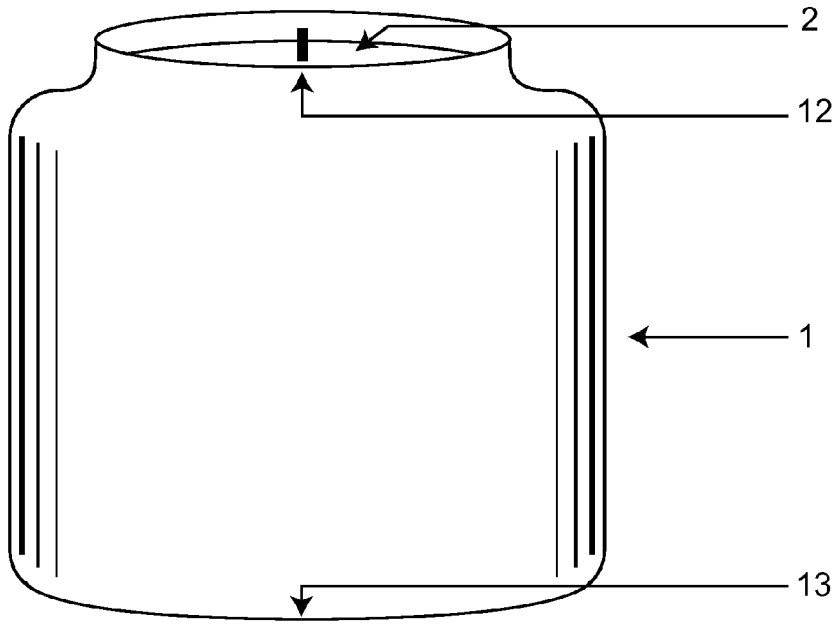
FIG. 1 depicts a perspective view of a container candle according to an embodiment of the invention.
Figure 2:
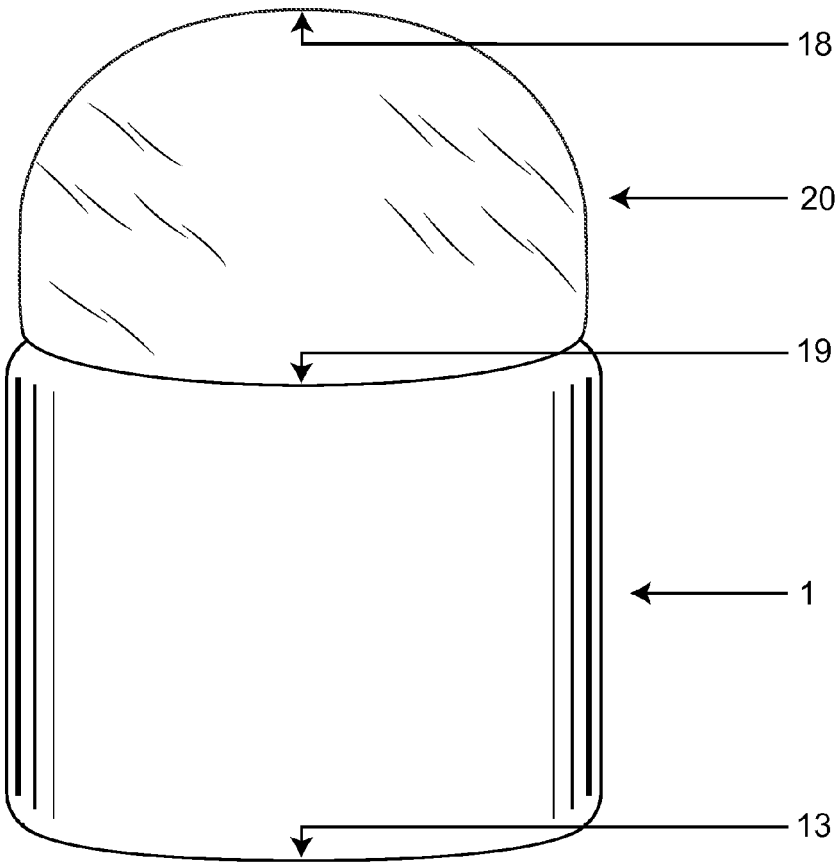
FIG. 2 depicts a perspective view of an assembled container candle system according to an embodiment of the invention.

A preferred embodiment of the container candle 1 and container candle lid 20, or lid 20, of the present invention are depicted in FIGS. 1 and 2. The depicted container 1 is cylindrical with a closed end 13, or base 13. The container 1 also possesses an open end 12, or container mouth 12, opposing the base 13. A candle 2 is disposed within the container 1. The lid 20 is spherical with a closed end 18 and an open end 19, or lid mouth 19. An alternative embodiment would permit the lid 20 to be cylindrical, conical, square, or some other geometric shape. The lid mouth 19 has a slightly larger diameter than the container mouth 12 which permits the lid 20 to be fittedly placed on the container 1 by sliding the lid mouth 19 over the container mouth 12. An alternative embodiment would permit the lid mouth 19 to have a smaller diameter than the container mouth 12, which would permit the lid 20 to be fittedly placed in the container mouth 12 by inserting the lid mouth 19 into the container mouth 12.

Figure 3:
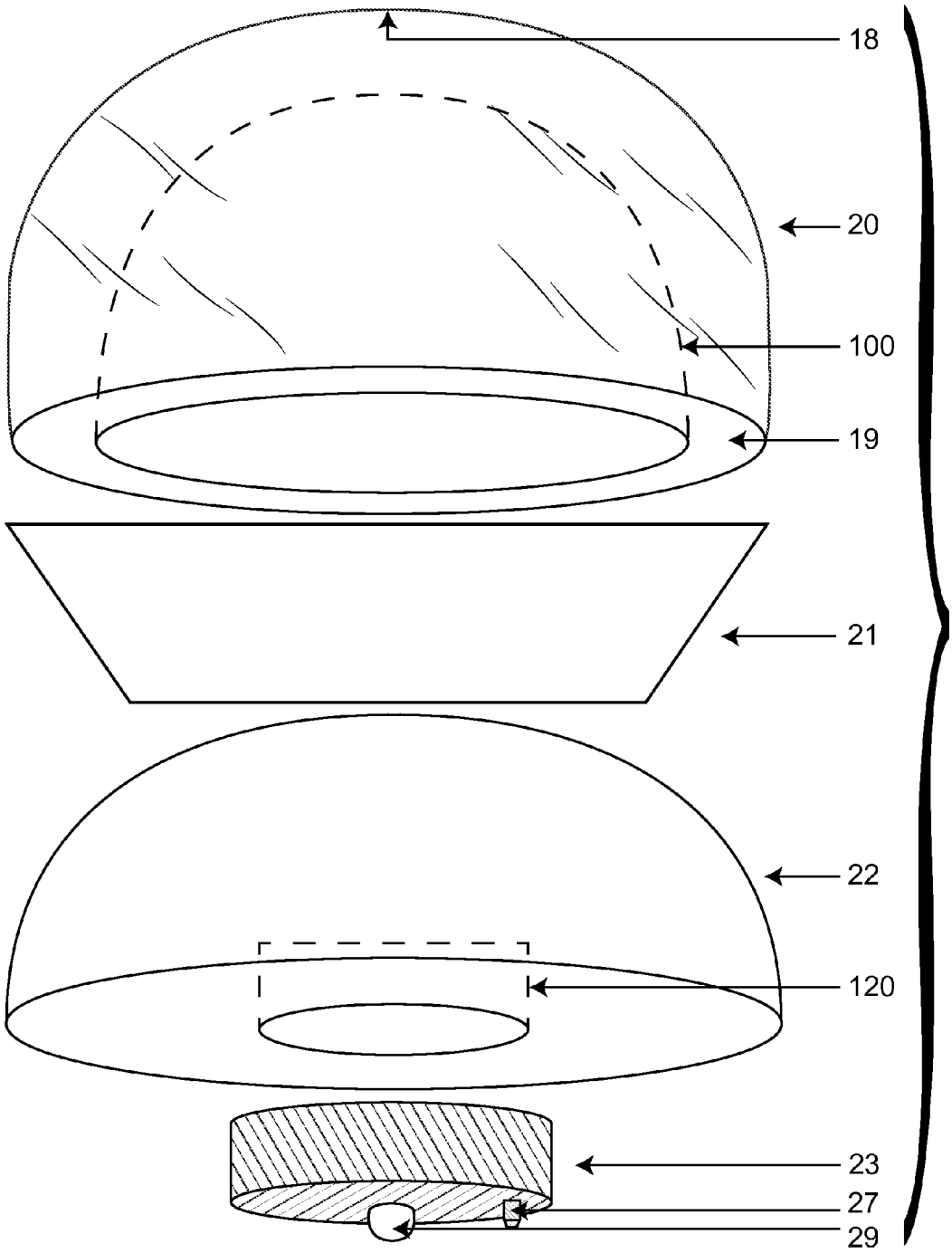
FIG. 3 depicts an exploded view of the invention.
Figure 4:
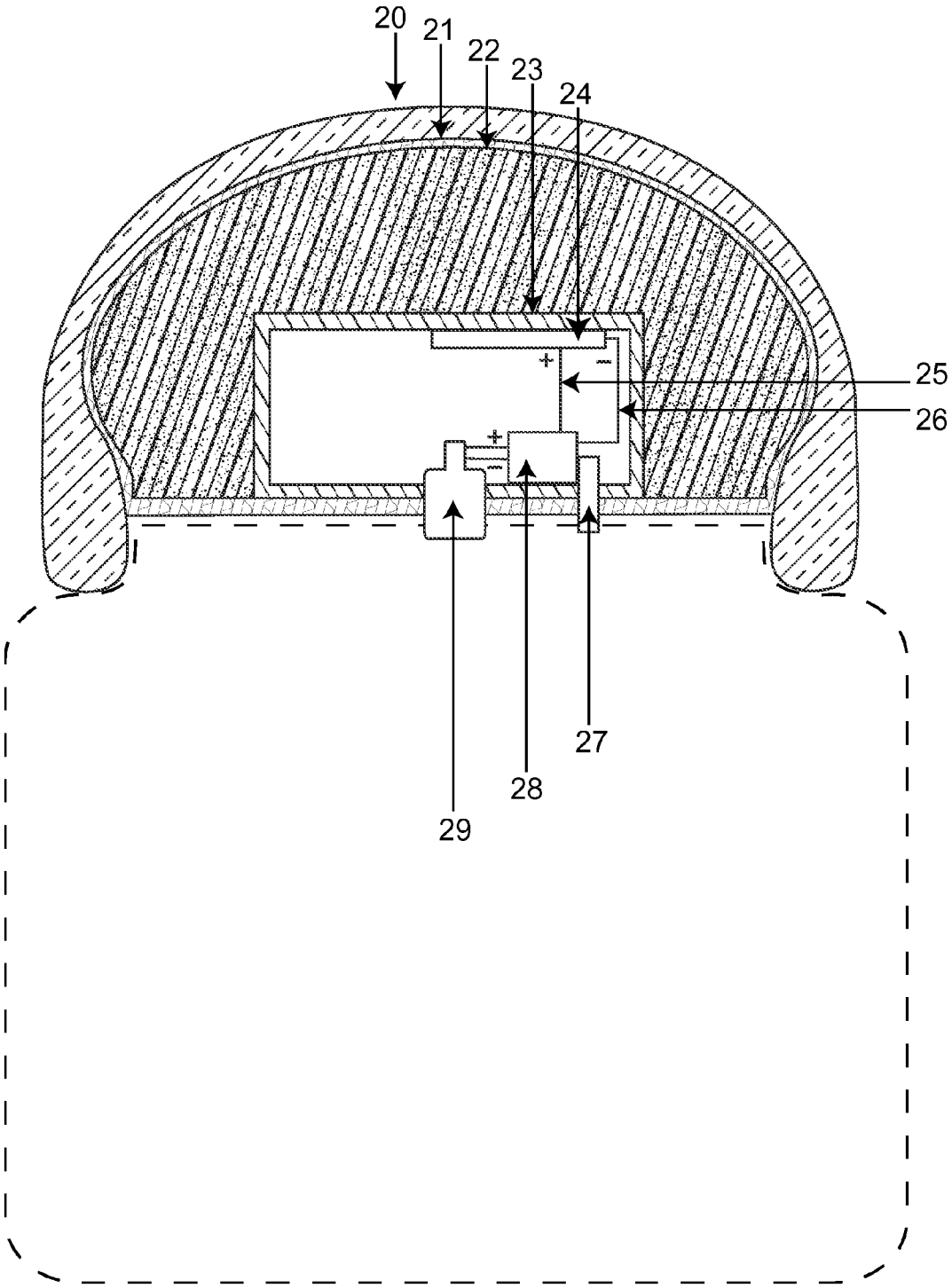
FIG. 4 depicts a cross-sectional view of the invention.

FIGS. 3 and 4 depict the component parts of the invention in exploded and cross-sectional views, respectively. Depicted are the lid 20, two-dimensional material 21, or material 21, polyurethane foam 22, or foam 22, and LED housing 23 (which contains a DC power source 24, power leads of a positive polarity 25 and negative polarity 26, an on/off toggle 27, a resistor and on/off switch 28, and an LED 29).

In the preferred embodiment of the invention, the material 21 consists of at least one sheet of decorative paper but could also consist of at least one sheet of fabric, or at least one photograph, or at least one lithographic illustration, or at least one sheet of some other decorative two-dimensional material, or any combination of two-dimensional materials.

In the preferred embodiment of the invention, the material 21 is of sufficient size that it can be applied to the majority of the interior surface of the lid 100, or interior surface 100.

Alternately, the material 21 is fused to the foam.

In the preferred embodiment of the invention, the LED housing 23 is cylindrical.

Alternately, the LED housing could be a cube, sphere, or some other geometric shape Alternately, some or all of the components contained in the LED housing could be embedded directly into the foam 22.

In the preferred embodiment of the invention, the on/off toggle 27 is located on the same side of the LED housing 23 as the LED 29.

In the preferred embodiment of the invention, the LED 29 is rounded but could, alternately, be shaped like a flame, start, flower, or some other decorative three-dimensional shape.

Referring to FIG. 3, the foam 22 has a cylindrical hole 120, or hole 120, with a diameter that is smaller than the diameter of the LED housing 23, such that when the LED housing 23 is nested it in the hole 120, the foam 22 is sufficiently compressed thereby exerting sufficient expansive force upon the LED housing 23 to overcome gravity and hold the LED housing 23 in place.

The interior surface 100 of the lid 20 is sufficiently smaller than the exterior surface of the foam 22, such that when the foam 22 and material 21 are nested within the lid 20, the foam 22 is sufficiently compressed thereby exerting enough expansive force upon the material 21, and the interior surface 100, that the foam 22 holds the material 21 against the interior surface 100.

The lid can be fabricated of any suitable material such as glass, resin, or plastic. The other components of the invention, less the foam 22 and the LED housing 23, are readily available, requiring no special manufacturing process. In the preferred embodiment, the foam 22 is cut from polyurethane stock with an appropriately configured die such that the die simultaneously defines the exterior of the foam 22, as well as the hole 120. The LED housing is made of plastic using industry-standard injection molding and a specially created mold that permits the on/off toggle 27 to be located on the same side as the LED.

The invention can be assembled by hand without any special tools. One turns the holed-side of the foam 22 up, tilts the LED housing 23 at an angle relative to the foam 22, and inserts the leading edge of the LED housing 23 into the hole 120, thereby compressing the foam and securing the LED housing. The foam 22, which now has the LED housing 23 nested in it, is inverted, the material 21 is placed over the side of the foam opposite the hole 120. The LED housing 23, foam 22, and material 21 are pushed into the lid 20. As described above, the interior dimensions of the lid 100 cause the foam 22 to compress, which creates the force necessary to hold the material 21 against the interior surface of the lid 100.

The invention claimed is:

1. A candle system comprising:

a container having a candle therein;

a transparent or translucent lid with an interior cavity, the lid configured such that it can be fixedly coupled and removed from the container, and the interior cavity of said lid is exposed on the side that faces the candle;

a sheet of material lining the interior surface of the interior cavity;

a piece of foam placed within and compressed so as to conform to the interior cavity, the foam having a volume that is greater than the volume of the interior cavity of said lid in an uncompressed state, and that has a consistency such that, after it is compressed and nested in the interior cavity of the lid, and it expands toward its original shape, it creates sufficient expansive force to hold itself and the sheet of material in place, and presses at least some of the sheet of material against the surface of the interior cavity of the lid, an LED light assembly comprising:

a housing an LED light bulb;

wherein the foam has a cavity, on a side of the foam which faces the candle, into which the LED light assembly is nested;

the housing is sufficiently larger than the cavity in the foam into which the housing is nested, such that after the housing is nested, the foam exerts enough expansive force against the housing to hold the housing in place.

2. A candle system according to claim 1, wherein the foam can be inserted into or removed from the interior cavity of the lid without any special tools.

3. A candle system according to claim 1, the housing is positioned within the cavity of the foam such that after the LED light bulb is energized, light illuminates at least some of the transparent or translucent lid, at least some of the sheet of material, and at least some of the container to which the lid system is attached.

4. A candle system according to claim 1, the LED assembly can be inserted into or removed from the cavity of the foam without any special tools.

* * * * *